US005645342A

United States Patent [19]

Chang

[11] Patent Number: 5,645,342

[45] Date of Patent: Jul. 8, 1997

[54] DECORATIVE CHRISTMAS TREE ILLUMINATION ASSEMBLY

[76] Inventor: Chin Chen Chang, No. 9, Lane 305, Pei Ta Road, Hsin Chu, Taiwan

[21] Appl. No.: 650,800

[22] Filed: May 20, 1996

[51] Int. Cl.[6] ..... F21P 1/00

[52] U.S. Cl. ..... 362/252; 362/123; 362/227; 362/249; 362/806

[58] Field of Search ..... 362/806, 123, 362/227, 234, 249, 252

[56] References Cited

U.S. PATENT DOCUMENTS 5,424,925 6/1995 Jenke et al. ..... 362/252

*Primary Examiner*—Carroll B. Dority

[57] ABSTRACT

A Christmas tree light assembly in the form of a net is provided which can be draped over the tree. The assembly includes a plurality of interconnected light bulbs seated within their respective sockets at the nodes formed by the interconnecting conductive, insulating wires which are energized by an electrical switch.

12 Claims, 3 Drawing Sheets

DECORATIVE CHRISTMAS TREE ILLUMINATION ASSEMBLY

FIELD OF THE INVENTION

This invention relates generally to decorative illumination of Christmas trees, and is particularly related to a Christmas tree light assembly made of a web or a net structure comprising a plurality of interconnected light elements. The net structure which comprises the interconnected light elements is pre-fabricated and adapted for draping as a single net over a Christmas tree.

BACKGROUND OF THE INVENTION

A variety of Christmas lights and decorative assemblies are available for illuminating and decorating Christmas trees. Conventional illumination of a Christmas tree involves the use of a plurality of separate elongated, insulative, electrically conductive wire strings on which are mounted several lighting elements (lamps) which are spaced apart from each other. Each of these lights element comprises a female socket member which is adapted to receive a screw-in or bayonet-type lamp, strung in series or in parallel. The strings are attached at one or both ends to an electrical plug which provides the source of electricity. See U.S. Pat. No. 5,057,976 issued to Sheila DuMong on Oct. 15, 1991. As mentioned in said patent, however, the mounting of such plurality of separate strings of lights on a Christmas tree is both is burdensome and time-consuming task. In order to simplify decoration of a Christmas tree by illumination, said patent provides a tree lighting assembly that incorporates a multiplicity of lamps in a net-like structure that can be readily mounted on a Christmas tree, and is easy to remove when not in use.

Other Christmas tree decorative illumination assemblies are described in the prior art patents disclosed in the DuMong patent. These are Crucefix U.S. Pat. No. 4,870,547 and Forrer U.S. Pat. No. 3,096,943. The DuMong patent also discloses two other patents, i.e., Ahoroni U.S. Pat. Nos. 4,720,773 and 4,736,282 which describe a mounting collar for use with conventional strings of Christmas lights.

In a more recent patent, i.e., U.S. Pat. No. 5,213,519 issued to David J. Dorfman on May 25, 1993, the patentee describes an electrical receptacle assembly which, in one embodiment, forms a flexible net. The receptacles receive light bulbs therein which, when illuminated, form a blanket of lights that can be draped over and around a Christmas tree.

Other decorative light assemblies for Christmas trees are disclosed in U.S. Pat. Nos. 5,338,585; 5,424,925 and 4,720,773.

For one or more reasons, the decorative light assemblies which have heretofore been described or used to illuminate Christmas trees have had one or more deficiencies which have limited their use for this purpose.

SUMMARY OF THE INVENTION

It is an object of this invention to provide a Christmas tree illumination assembly that comprises multiplicity of interconnected lamps which form a net-like structure that can be draped over of Christmas tree.

It is another object of this invention to provide a Christmas tree illumination assembly of light bulbs the form of a net of different shapes and sizes for ready mounting over a Christmas tree, and which is easily removed therefrom.

It is still an object of this invention to provide a Christmas tree lighting and decorative assembly which is pre-fabricated as a unitary net structure, thus obviating the need for using a plurality of separate strings of lights and the usual difficulty of entanglements which is experienced when decorating a Christmas tree therewith.

The foregoing and other objects of this invention will be more fully appreciated with reference to the ensuing detailed description of the invention taken in conjunction with the accompanying drawings.

BRIEF DESCRIPTION OF THE DRAWINGS

In the drawings wherein like reference numerals are used to designate like elements.

DETAILED DESCRIPTION OF THE DRAWINGS

Figure 1:
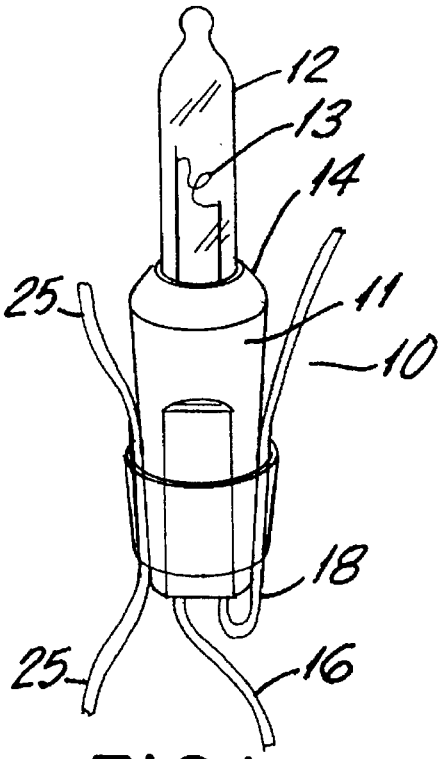
FIG. 1 is an enlarged perspective view of a Christmas tree lamp designed for use in the present invention.

Referring first to FIGS. 1–5, there is shown, in FIG. 1, a lamp structure generally designated as 10 suitable for use in the Christmas tree web assembly of the present invention. The lamp structure 10 comprises a cylindrical body 11, a bulb 12 having electrical filament 13 and the base 14 which fits into the socket 15 formed at the top of the cylindrical body 11.

A first elongated and electrically conductive, insulated wire 16 is attached, at one end, to a first metal plate member 17 in the socket 15 (see FIG. 5), and a second electrically conductive insulated wire 18 is attached to a second metal plate 19 also disposed within the socket 15. The bulb or lamp 12 has the plastic base 14 (see FIG. 4) with exposed wires 21 and 22 disposed on opposite sides of the base 14 and contact the metal plates 17 and 19.

Figure 2:
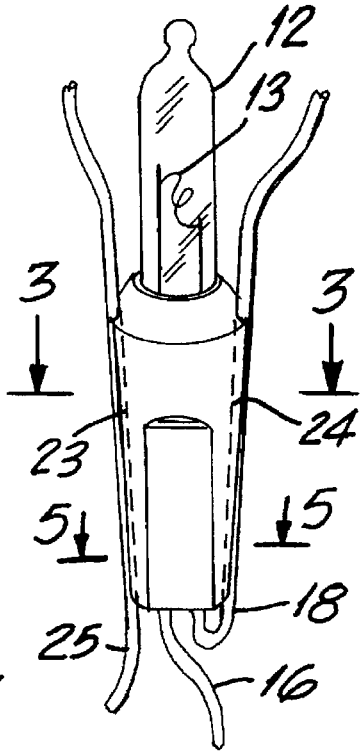
FIG. 2 is an enlarged perspective view of an alternative embodiment of a Christmas tree lamp suitable for use in the present invention.
Figure 3:
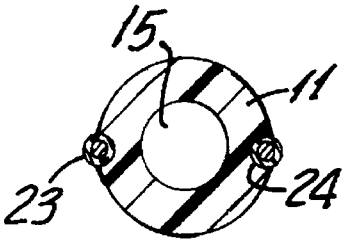
FIG. 3 is a cross-sectional view taken along the line 3—3 of FIG. 2.

In the embodiment shown in FIG. 2 and 3 the sides of the cylindrical body 11 include the elongated grooves 23, 24 disposed on opposite sides thereof, through which extend the wires 16 and 18, respectively.

Figure 6:
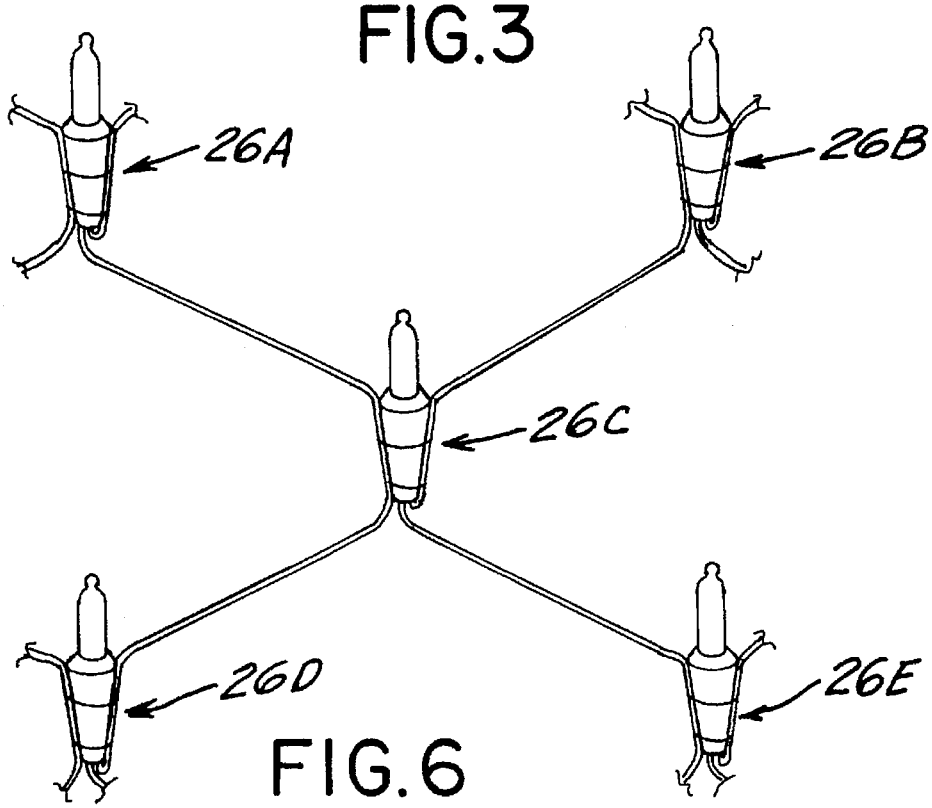
FIG. 6 is a perspective view of a partial assembly of the web formed by the interconnected lamps of the present invention.
Figure 4:
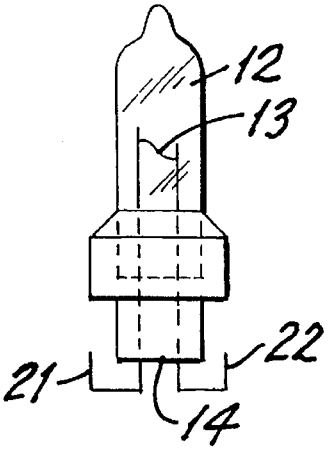
FIG. 4 is an enlarged perspective view of the light bulb shown in FIGS. 1 and 2.
Figure 5:
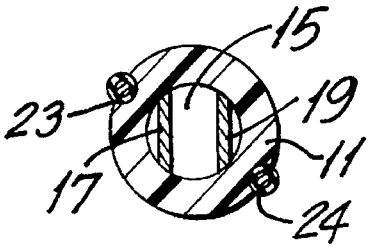
FIG. 5 is a cross-sectional view taken along the line 5—5 of FIG. 2.

As shown in FIGS. 1, 2 and 6, the wires 16 and 18 terminate in the cylindrical body 11 and are electrically connected to the bulb 12. The wire 25 is retained against the cylindrical body 11 by a polyvinylchloride (PVC) cover sleeve or a suitable adhesive tape, which also serves to retain the wire 18 against the other sides of the base, but which is not electrically connected to the bulb 12.

Figure 7:
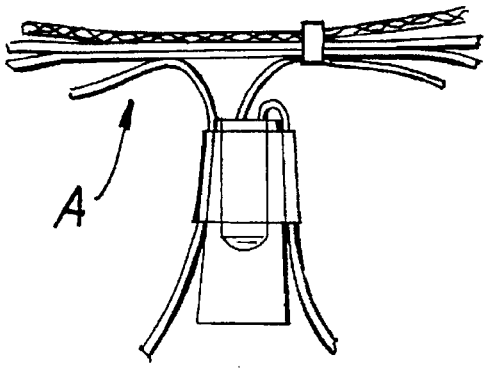
FIG. 7 is an enlarged side view showing the connection of a lamp base with the electrical wires of the lighting assembly.
Figure 8:
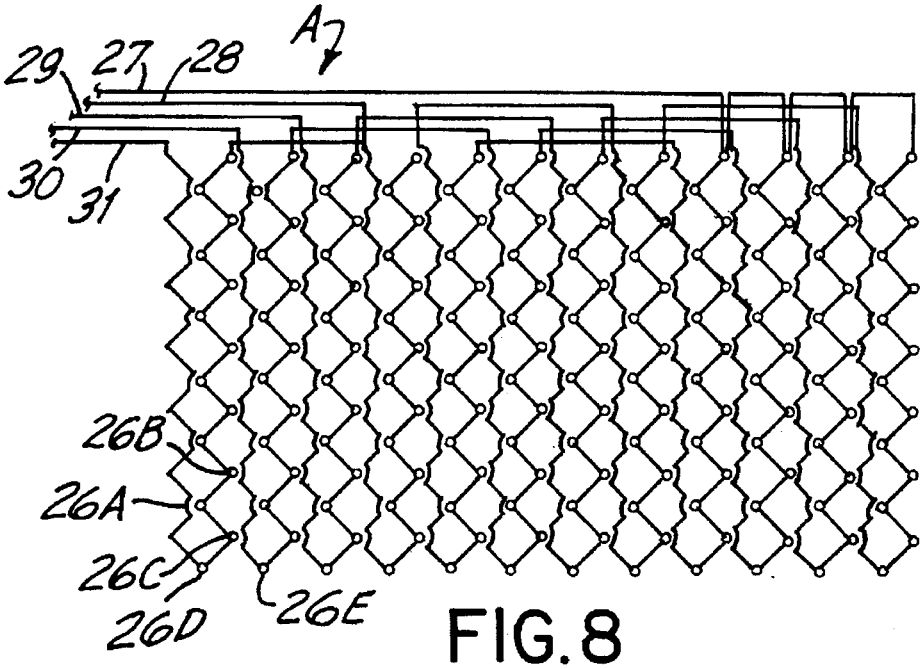
FIG. 8 is a top plan view of the web of Christmas tree lights arranged in accordance with one embodiment of this invention.

As shown in FIGS. 7 and 8, the web of interconnected light structure consists of a plurality of bulbs 12 such as shown in FIGS. 1–3, and wires which physically and electrically interconnect these lamps. The bulbs 12 form the nodes 26A–26N in the web, wherein N is an integer number representing the number of desired lamps. In the embodiment shown in FIG. 6 only nodes 26A–26E are shown but it can be appreciated that the net structure can include as few as 10 and as many as 200 or more nodes depending on the desired size of the web and number of lamps used in the web.

Figure 10:
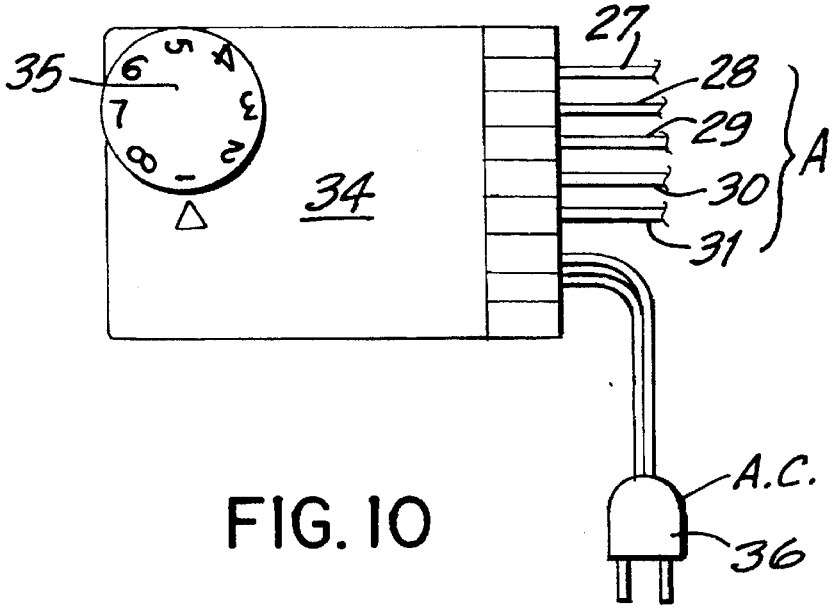
FIG. 10 is a top view of the electrical control box which provides the source of energy for the web of interconnected lights of the present invention.

In the embodiments shown in FIGS. 7 and 8, the web is formed such that it has five wires 27, 28, 29, 30 and 31 leading into an electrical control switch 32 as shown in FIG. 10.

Figure 9:
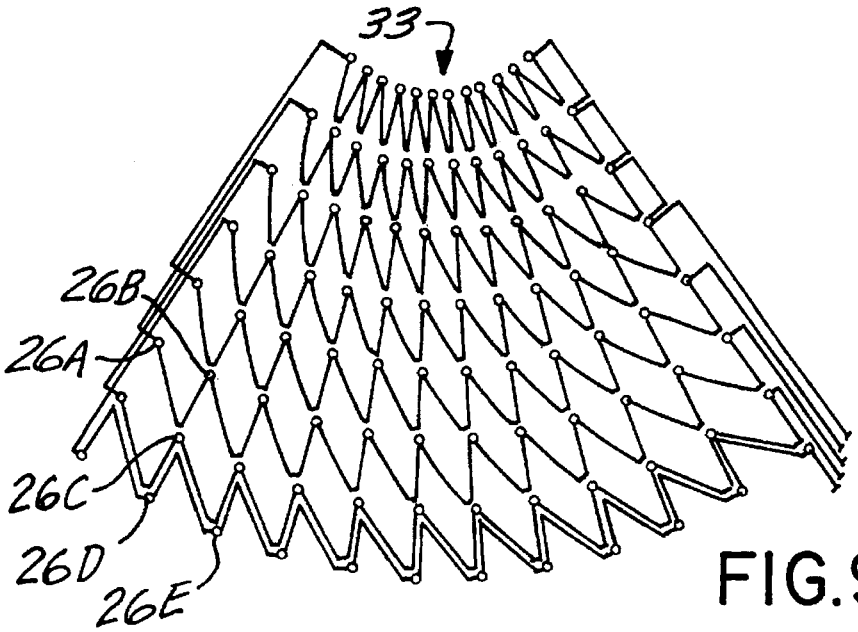
FIG. 9 is a view showing an alternative arrangement of the web of Christmas tree lights used in accordance with a different embodiment of this invention.

In the embodiment illustrated in FIG. 9 the web is formed into a general conical shape having a base 33 which is wider than its top section 32. As in the embodiment of FIG. 8, the web includes five wires 27A, 28A, 29A 30A and 31A which lead to the electrical control switch 34.

The electrical control switch 32 has an integrated circuit and a control dial 35. This switch may be connected to a household power source, usually 110 volt AC, through conventional electrical plug 36. The control switch is provided with the control dial 35 marked with numerical indicia of from 1 to 8 which correspond to:

1. combination
2. in wave
3. sequential
4. slo-glo
5. sparkling/chasing
6. fade on/off
7. sparkling
8. steady burn The dial can be set to the desired numerical indicia in order to obtain the desired illumination results.

While the present invention has been described with some degree of particularity, it is readily apparent that many changes and modifications may be suggested which are nevertheless within the scope and contemplation of this invention. For example, the web or net structure need not necessarily by conical but may be rectangular, square or in other desired configurations. Also, the decorative net may be used to illuminate structures other than Christmas trees such as, for example, walls, buildings and other structures.

What is claimed is:

1. A decorative Christmas tree light assembly comprising a web including a plurality of Christmas tree light bulbs, the web being adapted to be draped over a Christmas tree; the assembly comprising:

(a) at least three pairs of insulated wires, each pair of insulated wires comprising a first insulated wire and a second insulated wire;

(b) said wires being formed into the web with the wires crossing at nodes of the web, a socket being positioned at least at about every node of the web; and (c) wherein at each node said socket is joined to a wire passing through that node.

2. A decorative Christmas tree light assembly comprising a web including a plurality of Christmas tree light bulbs, the web being adapted to be draped over a Christmas tree; the assembly comprising:

(a) at least three pairs of insulated wires, each pair of insulated wires comprising a first insulated wire and a second insulated wire;

(b) said wires being formed into the web with the wires crossing at nodes of the web, a socket being positioned at least at about every node of the web; and (c) wherein at each node said socket is joined to a wire passing through that node;

(d) a control box;

(e) an integrated circuit means in the control box and electrically connected to the three pairs of wires to control the bulbs to effect fade on/fade off, sequential-wave, steady burn and sparkling;

(f) switch means on the control box to control the integrated circuit to select one of said light effects, and (g) an electrical plug means to connect the web to household electrical current, the plug means being electrically connected to the lamp bulbs and the integrated circuit.

3. A Christmas tree web as in claim 1 wherein at each node two wires are connected into each socket.

4. A Christmas tree web as in claim 1 wherein said wire is joined to said socket by a fastener.

5. A Christmas tree web as in claim 1 wherein the wires and socket are of a color which visually blends with the color of the tree.

6. A Christmas tree web as in claim 1 wherein at each node two wires are connected into each socket and further including, at some nodes, a plastic wire strap to secure together a plurality of the wires.

7. A Christmas tree web as in claim 1 wherein each socket comprises an injection molded member having a cavity therein and having metal contact plates positioned on opposite sides of said cavity, each contact plate being connected to one wire of the web.

8. A Christmas tree web as in claim 2 wherein at each node two wires are connected into each socket.

9. A Christmas tree web as in claim 4 wherein the fastener means on each socket is a transparent and adhesive tape.

10. A Christmas tree web as in claim 2 wherein the wires and socket are of a color which visually blends with the color of the tree.

11. A Christmas tree web as in claim 2 wherein at each node two wires are connected into each socket and further including, at some nodes, a plastic wire strap to secure together a plurality of the wires.

12. A Christmas tree web as in claim 2 wherein each socket comprises an injection molded member have a cavity therein and having metal contact plates positioned on opposite sides of the cavity, each contact plate being connected to one wire of the web.

* * * * *

US005645342B1

(12) REEXAMINATION CERTIFICATE (4480th)

United States Patent

Chang

(10) Number: US 5,645,342 C1

(45) Certificate Issued: Nov. 6, 2001

(54) DECORATIVE CHRISTMAS TREE ILLUMINATION ASSEMBLY

(75) Inventor: Chin Chen Chang, Hsin Chu (TW)

(73) Assignee: Golden Bay Enterprises, Inc., Hempstead, NY (US)

Reexamination Request:
No. 90/004,966, Apr. 14, 1998

Reexamination Certificate for:

| | |
|---|---|
| Patent No.: | **5,645,342** |
| Issued: | **Jul. 8, 1997** |
| Appl. No.: | **08/650,800** |
| Filed: | **May 20, 1996** |

(51) Int. Cl.[7] ..... F21S 4/00

(52) U.S. Cl. ..... 362/252; 362/123; 362/249; 362/806; 362/234

(58) Field of Search ..... 362/249, 252, 362/123, 806, 227, 234

(56) References Cited

U.S. PATENT DOCUMENTS 5,662,409 9/1997 Huang ..... 362/249

*Primary Examiner*—Thomas M Sember

(57) ABSTRACT

A Christmas tree light assembly in the form of a net is provided which can be draped over the tree. The assembly includes a plurality of interconnected light bulbs seated within their respective sockets at the nodes formed by the interconnecting conductive, insulating wires which are energized by an electrical switch.

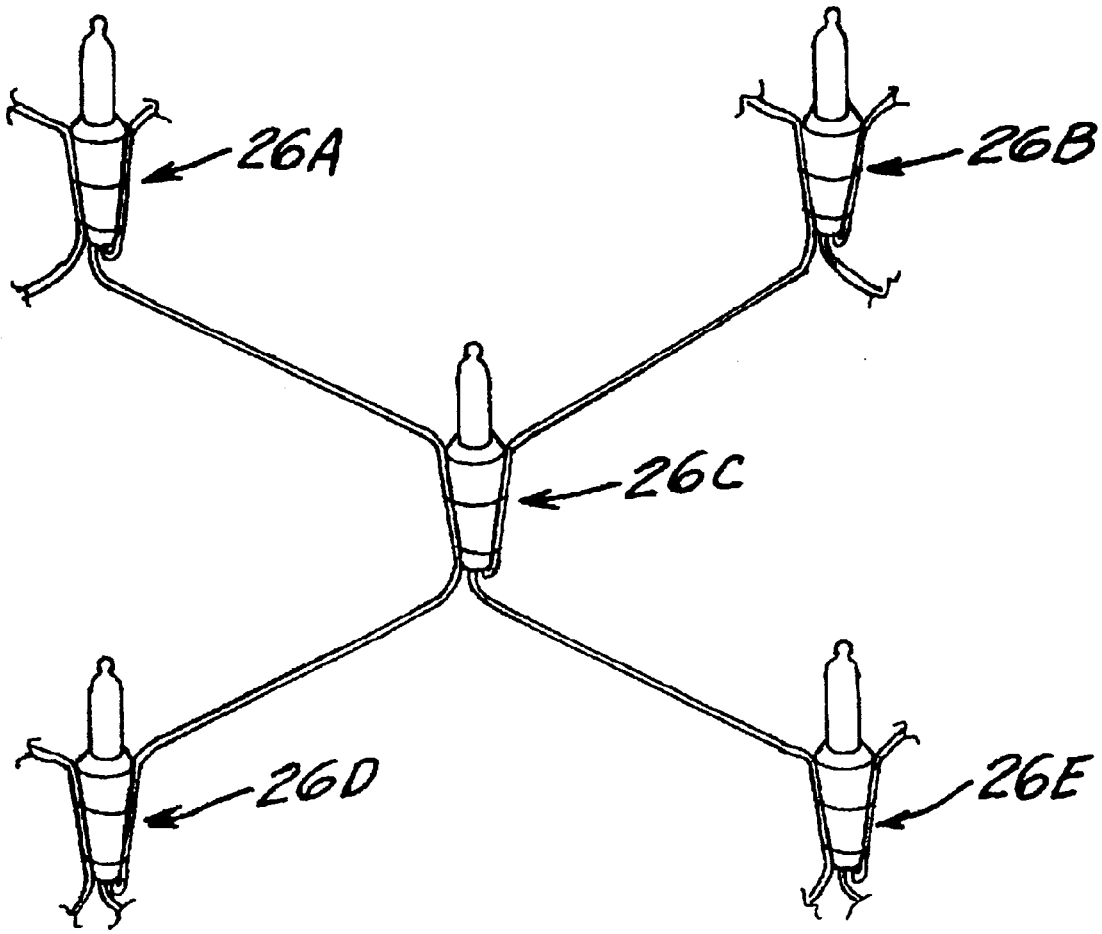

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–12 is confirmed.

* * * * *

US005645342C1

(12) EX PARTE REEXAMINATION CERTIFICATE (4899th)

United States Patent

Chang

(10) Number: US 5,645,342 C2

(45) Certificate Issued: Jan. 27, 2004

(54) DECORATIVE CHRISTMAS TREE ILLUMINATION ASSEMBLY

(75) Inventor: Chin Chen Chang, Hsin Chu (TW)

(73) Assignee: Golden Bay Enterprises, Inc., Hempstead, NY (US)

Reexamination Request:
No. 90/006,106, Sep. 7, 2001

Reexamination Certificate for:

| | |
|---|---|
| Patent No.: | **5,645,342** |
| Issued: | **Jul. 8, 1997** |
| Appl. No.: | **08/650,800** |
| Filed: | **May 20, 1996** |

Reexamination Certificate B1 5,645,342 issued Nov. 6, 2001

(51) Int. Cl.[7] ..... F21S 4/00

(52) U.S. Cl. ..... 362/252; 362/123; 362/227; 362/249; 362/806

(58) Field of Search ..... 362/123, 227, 362/249, 251, 252, 234, 806

(56) References Cited

U.S. PATENT DOCUMENTS

| | | | | | |
|---|---|---|---|---|---|
| 3,096,943 | A | | 7/1963 | Forrer | |
| 4,241,387 | A | | 12/1980 | Bowers | 362/252 |
| 4,802,072 | A | | 1/1989 | Kau | 362/238 |
| 4,870,547 | A | | 9/1989 | Crucefix | 362/123 |
| 4,899,266 | A | * | 2/1990 | Ahroni | 362/252 |
| 5,057,976 | A | | 10/1991 | DuMong | 362/123 |
| 5,213,409 | A | | 5/1993 | Fisher | 362/252 |
| 5,213,519 | A | * | 5/1993 | Dorfman | 362/123 |
| 5,245,519 | A | | 9/1993 | Openiano | 362/252 |
| D354,269 | S | | 1/1995 | Liu | D13/134 |
| 5,601,361 | A | | 2/1997 | Lawrence | 362/238 |
| 5,632,550 | A | | 5/1997 | Yeh | 362/123 |
| 5,716,124 | A | | 2/1998 | Hsu | 362/252 |
| 5,747,940 | A | | 5/1998 | Openiano | 315/185 S |

* cited by examiner

*Primary Examiner*—Alan Cariaso

(57) ABSTRACT

A Christmas tree light assembly in the form of a net is provided which can be draped over the tree. The assembly includes a plurality of interconnected light bulbs seated within their respective sockets at the nodes formed by the interconnecting conductive, insulating wires which are energized by an electrical switch.

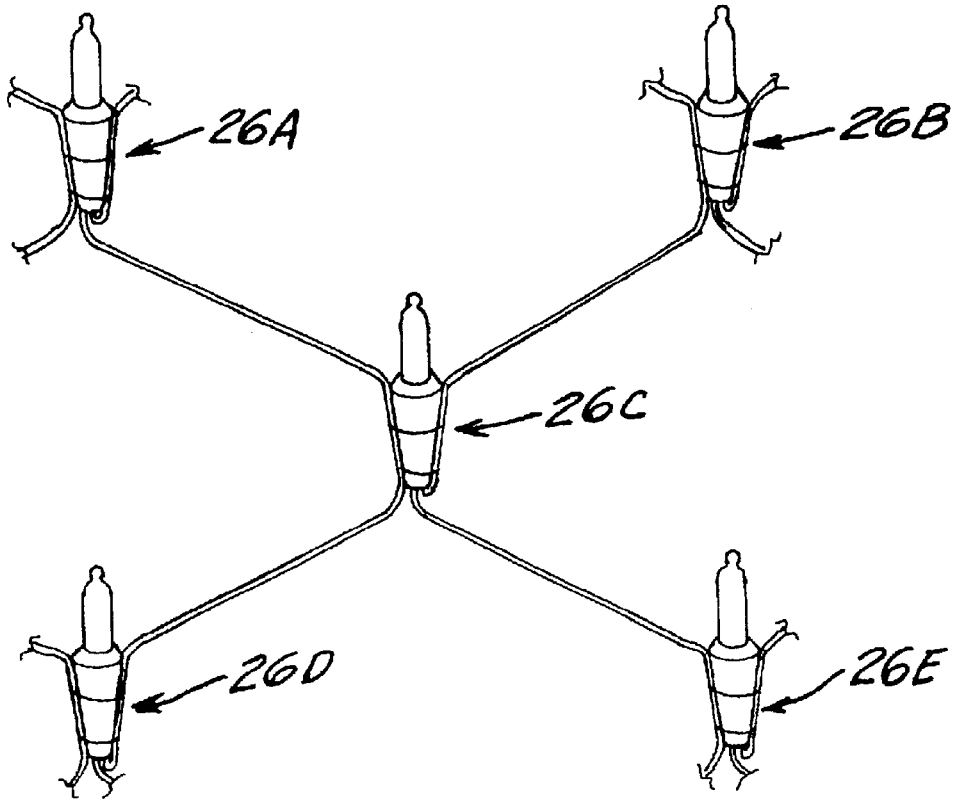

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 2, 8, 10, 11 and 12 is confirmed.

Claim 1 is determined to be patentable as amended.

Claims 3–7 and 9, dependent on an amended claim, are determined to be patentable.

1. A decorative Christmas tree light assembly comprising a web including a plurality of Christmas tree light bulbs, the web being adapted to be draped over a Christmas tree; the assembly comprising:

(a) at least three pairs of insulated wires, each pair of insulated wires comprising a first insulated wire and a second insulated wire;

(b) said wires being formed into the web with the *first insulated wire and the second insulated* wire[s] crossing at nodes of the web *in substantially opposite directions*, a socket being positioned at least at about every node of the web; and (c) wherein at each node said socket is joined to [a] *another* wire passing through that node*, not electrically connected to said socket*.

* * * * *